US008820733B2

(12) United States Patent
Arimura

(10) Patent No.: US 8,820,733 B2
(45) Date of Patent: Sep. 2, 2014

(54) SHEET FEEDING DEVICE, AND IMAGE READING DEVICE AND IMAGE FORMING APPARATUS INCLUDING THE SHEET FEEDING DEVICE

(71) Applicant: Kyocera Document Solutions Inc., Osaka (JP)

(72) Inventor: Shingo Arimura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/083,125

(22) Filed: Nov. 18, 2013

(65) Prior Publication Data

US 2014/0138904 A1 May 22, 2014

(30) Foreign Application Priority Data

Nov. 19, 2012 (JP) ..... 2012-253277

(51) Int. Cl.

| | |
|---|---|
| ***B65H 3/16*** | (2006.01) |
| ***B65H 5/06*** | (2006.01) |
| ***B65H 3/06*** | (2006.01) |
| ***B65H 7/02*** | (2006.01) |

(52) U.S. Cl.

CPC .. *B65H 7/02* (2013.01); *B65H 5/06* (2013.01); *B65H 3/06* (2013.01)

USPC ..... 271/18.1; 271/9.09

(58) Field of Classification Search

CPC ..... B65H 2407/21; B65H 3/18; B65H 5/004; B65H 2301/5133; B65H 2301/5321; B65H 2515/716; G03G 15/6514; G03G 2215/00392

USPC ..... 271/18.1, 9.09

See application file for complete search history.

(56) References Cited

FOREIGN PATENT DOCUMENTS

JP 2006-208776 A 8/2006

*Primary Examiner* — Michael McCullough

(74) *Attorney, Agent, or Firm* — Studebaker & Brackett PC

(57) ABSTRACT

A sheet feeding device includes a grounding member arranged to a housing and electrically grounded, a sheet loading part arranged to the housing and loading a sheet, a sheet conveying path extending from the sheet loading part and conveying the sheet in a conveying direction, a sheet feeding part and a swinging member. The sheet feeding part is arranged facing to the sheet loading part and conveys the sheet on the sheet loading part in the conveying direction. The electro-conductive swinging member is swingably supported to the housing and swung in a first direction by bring the sheet from the sheet loading part into contact with the swinging member. The swinging member includes a first contact part receiving the contact of the sheet and a second contact part coming into contact with the grounding member accompanying to the swing in the first direction of the swinging member.

20 Claims, 8 Drawing Sheets

SHEET FEEDING DEVICE, AND IMAGE READING DEVICE AND IMAGE FORMING APPARATUS INCLUDING THE SHEET FEEDING DEVICE

INCORPORATION BY REFERENCE

This application is based on and claims the benefit of priority from Japanese Patent application No. 2012-253277 filed on Nov. 19, 2012, the entire contents of which are incorporated herein by reference.

BACKGROUND

The present disclosure relates to a sheet feeding device feeding a sheet, and an image reading device and an image forming apparatus including this sheet feeding device.

As a sheet feeding device feeding a sheet, the following technique is known. This sheet feeding device feeds the sheet one by one from a sheet loading part to a sheet conveying path. The sheet feeding device includes a sheet feeding roller and a separation pad. The sheet feeding roller is driven to rotate, thereby feeding the sheet in a sheet conveying direction. The separation pad comes into contact with the sheet feeding roller, thereby forming a nip part with a circumference face of the sheet feeding roller.

The sheet is inserted to the nip part between the sheet feeding roller and separation pad and fed by the rotation of the sheet feeding roller. When the sheets loaded in the sheet loading part are adhered to each other by static electricity, there is a malfunction (overlapped feeding) that several sheets are inserted to the nip part and conveyed. By contrast, for example, there is a technique of eliminating the static electricity on the sheet (i.e. static-eliminating the sheet) by an electro-conductive member. In an intermediate tray to which the sheet is carried, the electro-conductive member comes into contact with a width alignment guide controlling a position of the sheet, and then, by the electro-conductive member, the sheet is static-eliminated.

In the above-mentioned technique, the sheet is static-eliminated by bringing the electro-conductive member into contact with the sheet loaded in the sheet loading part. In such a case, if many sheets are loaded, there is a problem that the static-elimination is insufficient for the sheets and that the sheets are overlappedly fed.

SUMMARY

In accordance with an embodiment of the present disclosure, a sheet feeding device includes a housing, a grounding member, a sheet loading part, a sheet conveying path, a sheet feeding part and a swinging member. The grounding member is arranged to the housing and electrically grounded. The sheet loading part is arranged to the housing and, on sheet loading part, a sheet is placed. The sheet conveying path extends from the sheet loading part and, in sheet conveying path, the sheet is conveyed in a predetermined conveying direction. The sheet feeding part is arranged facing to the sheet loading part and is configured to convey the sheet on the sheet loading part in the conveying direction. The swinging member is made of an electro-conductive member swingably supported to the housing so as to be swung in a first direction by bring the sheet conveyed from the sheet loading part into contact with the swinging member. The swinging member includes a first contact part with which the sheet is brought into contact and a second contact part coming into contact with the grounding member accompanying to the swing in the first direction of the swinging member.

In accordance with an embodiment of the present disclosure, an image forming apparatus includes an image forming part and a sheet feeding device. The image forming part forms an image on a sheet. The sheet feeding device conveys the sheet to the image forming part. The sheet feeding device includes a housing, a grounding member, a sheet loading part, a sheet conveying path, a sheet feeding part and a swinging member. The grounding member is arranged to the housing and electrically grounded. The sheet loading part is arranged to the housing and, on sheet loading part, a sheet is placed. The sheet conveying path extends from the sheet loading part and, in sheet conveying path, the sheet is conveyed in a predetermined conveying direction. The sheet feeding part is arranged facing to the sheet loading part and is configured to convey the sheet on the sheet loading part in the conveying direction. The swinging member is made of an electro-conductive member swingably supported to the housing so as to be swung in a first direction by bring the sheet conveyed from the sheet loading part into contact with the swinging member. The swinging member includes a first contact part with which the sheet is brought into contact and a second contact part coming into contact with the grounding member accompanying to the swing in the first direction of the swinging member.

In accordance with an embodiment of the present disclosure, an image reading device includes a reading part and a sheet feeding device. the reading part is arranged facing to a conveying path of a sheet and configured to read a document image on the sheet. The sheet feeding device conveys the sheet to the reading part. The sheet feeding device includes a housing, a grounding member, a sheet loading part, a sheet conveying path, a sheet feeding part and a swinging member. The grounding member is arranged to the housing and electrically grounded. The sheet loading part is arranged to the housing and, on sheet loading part, a sheet is placed. The sheet conveying path extends from the sheet loading part and, in sheet conveying path, the sheet is conveyed in a predetermined conveying direction. The sheet feeding part is arranged facing to the sheet loading part and is configured to convey the sheet on the sheet loading part in the conveying direction. The swinging member is made of an electro-conductive member swingably supported to the housing so as to be swung in a first direction by bring the sheet conveyed from the sheet loading part into contact with the swinging member. The swinging member includes a first contact part with which the sheet is brought into contact and a second contact part coming into contact with the grounding member accompanying to the swing in the first direction of the swinging member.

In accordance with an embodiment of the present disclosure, an image forming apparatus includes a sheet feeding device, a reading part and an image forming part. The sheet feeding device conveys a sheet as a document. The reading part is arranged facing to a conveying path of the sheet and configured to read a document image on the sheet. The image forming part forms an image on the sheet on the basis of the document image read by the reading part. The sheet feeding device includes a housing, a grounding member, a sheet loading part, a sheet conveying path, a sheet feeding part and a swinging member. The grounding member is arranged to the housing and electrically grounded. The sheet loading part is arranged to the housing and, on sheet loading part, a sheet is placed. The sheet conveying path extends from the sheet loading part and, in sheet conveying path, the sheet is conveyed in a predetermined conveying direction. The sheet feeding part is arranged facing to the sheet loading part and is configured to convey the sheet on the sheet loading part in the conveying direction. The swinging member is made of an electro-conductive member swingably supported to the housing so as to be swung in a first direction by bring the sheet conveyed from the sheet loading part into contact with the swinging member. The swinging member includes a first contact part with which the sheet is brought into contact and a second contact part coming into contact with the grounding member accompanying to the swing in the first direction of the swinging member.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
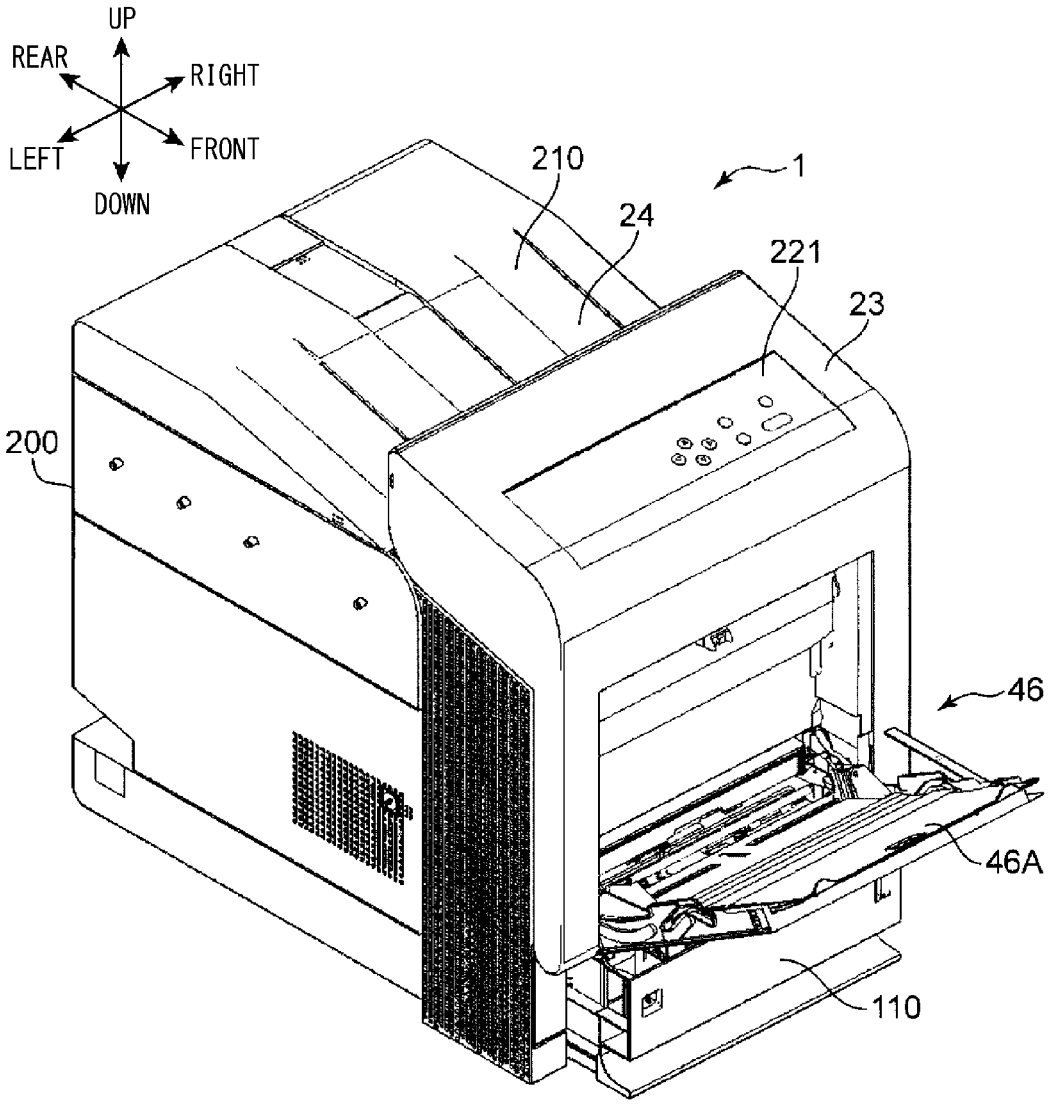
FIG. 1 is a perspective view schematically showing an image forming apparatus according to an embodiment of the present disclosure.
Figure 2:
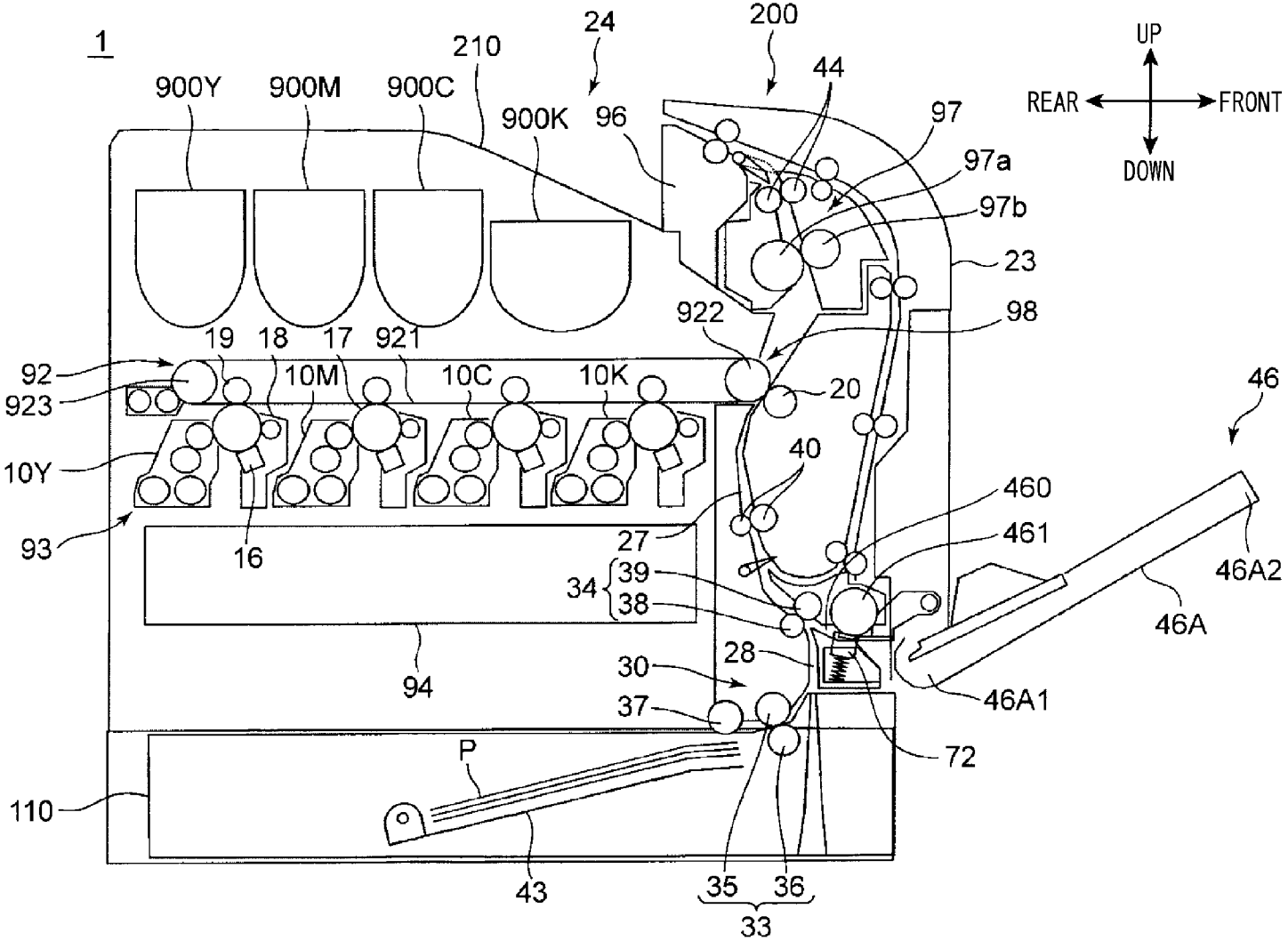
FIG. 2 is a sectional view schematically showing an internal structure of the image forming apparatus according to the embodiment of the present disclosure.

In the following, an embodiment of the present disclosure will be described in detail with reference to the drawings. FIG. 1 is a perspective view showing an image forming apparatus 1 according to the embodiment of the disclosure. FIG. 2 is a view schematically showing an internal structure of the image forming apparatus 1 shown in FIG. 1. The image forming apparatus 1 shown in FIGS. 1 and 2 is a so-called color printer, but, in another embodiment, the image forming apparatus may be a monochrome printer, a facsimile device or a multifunction peripheral having such functions, or another device forming a toner image on a sheet. Terms indicating the directions, such as "upper" (upward) and "lower" (downward), "front" (forward) and "rear" (backward), and "left" and "right", are used in the following description in order to clarify explanation, but these does not restrict a principle of the image forming apparatus. In the following description, a term of "sheet" means a copy sheet, a coated paper, an OHP (overhead projector) sheet, a card board, a postcard, a tracing paper or another sheet medium to which an image forming process is performed, or a further sheet medium to which an optional process except for the image forming process is performed.

As shown in FIG. 2, in a housing 200, an intermediate transfer unit 92, an image forming unit 93, an exposing unit 94, a fixing unit 97 and an ejecting unit 96 are provided. The housing 200 also includes a front cover 23 and, in a front face of the front cover 23, a manual bypass sheet feeding part (a sheet feeding device) 46 is located. The manual bypass sheet feeding part 46 includes a manual bypass tray 46A. The manual bypass tray 46A is attached turnably forward from the housing 200 in order to manually feed a sheet P. The sheet P conveyed from the manual bypass tray 46A by a sheet feeding roller (a sheet feeding part) 461 mentioned below is carried to a manual bypass sheet conveying path (a sheet conveying path) 460, and then, merged into a sheet conveying path 27. In the front cover 23, above the manual bypass sheet feeding part 46, an operation part 221 is located. A user manipulates the operation part 221 to input various print conditions. The operation part 221 includes a display part (not shown) to display various notification information.

The image forming unit 93 includes a yellow toner container 900Y containing a yellow toner, a magenta toner container 900M containing a magenta toner, a cyan toner container 900C containing a cyan toner and a black toner container 900K containing a black toner. In addition, the image forming unit 93 includes a yellow toner development device 10Y receiving the yellow toner from the yellow toner container 900Y, a magenta toner development device 10M receiving the magenta toner from the magenta toner container 900M, a cyan toner development device 10C receiving the cyan toner from the cyan toner container 900C and a black toner development device 10K receiving the black toner from the black toner container 900K. Moreover, the image forming unit 93 includes four photosensitive drums 17 receiving the toner from the corresponding development device 10Y, 10M, 10C and 10K and forming the toner image. As the photosensitive drum 17, a photosensitive drum made of an amorphous silicon-series (a-Si) material may be applied.

Around each photosensitive drum 17, a charger 16, the corresponding development device 10Y, 10M, 10C or 10K, a transfer roller 19 and a cleaner 18 are located. The charger 16 uniformly electric-charges a circumference face of the photosensitive drum 17. The transfer roller 19 is located at the opposite of the corresponding photosensitive drum 17 across an intermediate transferring belt 921 mentioned below to form a nip part with the photosensitive drum 17. The cleaner 18 cleans the circumference face of the photosensitive drum 17.

Below the image forming unit 93, the exposing unit is located. The exposing unit 94 includes a light source and various optical elements, such as a polygon mirror, a reflective mirror and a deflection mirror, and irradiates the circumference face of the photosensitive drum 17 with a light on the basis of image data.

The intermediate transfer unit 92 includes the intermediate transferring belt 921, a driving roller 922 and a following roller 923. The intermediate transferring belt 921 is stretched between the driving roller 922 and following roller 923 in a contact state with the circumference face of the photosensitive drum 17 and rotated in a predetermined direction. During the intermediate transferring belt 921 is rotated, the toner images from the photosensitive drums 17 are respectively first-transferred in the nip parts so as to be superimposed at same one place.

The first transfer of the toner image is carried out as follows. First, each charger 16 electric-charges the circumference face of the corresponding photosensitive drum 17, and then, the exposing unit 94 exposes each circumference face on the basis of the image data, thereby forming electrostatic latent images on the respective circumference faces. Next, the development devices 10Y, 10M, 10C and 10K develop the respective electrostatic latent images, thereby forming each toner image on the circumference face of the corresponding photosensitive drum 17. Subsequently, the toner images are respectively first-transferred from the circumference faces of the photosensitive drums 17 onto the intermediate transferring belt 921 in the nip parts so as to be superimposed at same one place. According to this, a color toner image is formed on the intermediate transferring belt 921. The cleaner 18 cleans the circumference face of the photosensitive drum 17 after the toner image is first-transferred.

At a position facing to the circumference of the driving roller 922, a second transfer roller 20 is located in a contact state with the driving roller 922. A nip part between the second transfer roller 20 and driving roller 922 works as a second transfer part 98. The color toner image on the intermediate transferring belt 921 is second-transferred onto the sheet P conveyed from a below-mentioned cartridge 110 in the second transfer part 98. The sheet P with the second-transferred image is conveyed to the fixing unit 97.

The fixing unit 97 carries out a fixing process to the toner image on the sheet P. The fixing unit 97 includes a fixing roller 97*a* installing a heat source and a pressing roller 97*b*. The pressing roller 97*b* is arranged facing to the fixing roller 97*a* in a contact state to form a fixing nip part with the fixing roller 97*a*. The sheet P after the fixing process has been completed is conveyed to the ejecting unit 96 arranged in an upper part of the housing 200 by a pair of ejecting rollers 44 arranged at a downstream side from the fixing roller 97*a* and pressing roller 97*b* in the fixing unit 97. The ejecting unit 96 ejects the sheet P conveyed from the fixing unit 97 onto a sheet ejected part 210 in an ejecting space 24 formed on an upper face of the housing 200.

The sheet P to which the toner image is formed is conveyed to the second transfer part 98 by the above-mentioned manual bypass sheet feeding part 46 and a sheet feeding device 30. The sheet feeding device 30 includes the cartridge 110 and sheet conveying path 27. The cartridge 110 is located below the exposing unit 94 and stores the sheet P. The sheet conveying path 27 extends from the cartridge 110 to the fixing unit 97 and conveys the sheet P from the cartridge 110 to the second transfer part 98. The cartridge 110 includes a lift board 43 on which a sheaf of the sheets (a sheet sheaf) are placed.

The sheet feeding device 30 further includes a group of rollers arranged along the sheet conveying path 27. The group of the rollers are composed of a pickup roller 37, a first conveying roller pair 33, a second conveying roller pair 34 and a pair of resist rollers 40 arranged in order from an upstream side to the downstream side in a sheet conveying direction in which the sheet P runs from the cartridge 110 to the second transfer part 98.

The pickup roller 37 is arranged above the lift board 43 and picks up the sheet P one by one from the sheet sheaf placed on the lift board 43 to convey the sheet P to the first conveying roller pair 33. The first conveying roller pair 33 conveys the sheet P conveyed from the pickup roller 37 to the second conveying roller pair 34 being positioned at a moreover downstream side. The sheet conveying path 27 has a curved conveying part 28 being curved between the first conveying roller pair 33 and second conveying roller pair 34. The curved conveying part 28 extends upward from the first conveying roller pair 33 to the second conveying roller pair 34, while being curved. When the sheet P is conveyed from the first conveying roller pair 33 to the second conveying roller pair 34, the sheet P becomes a curved state along a curved shape of the curved conveying part 28.

The second conveying roller pair 34 conveys the sheet P conveyed from the first conveying roller pair 33 to the pair of the resist rollers 40 being positioned at a further downstream side. The pair of the resist rollers 40 conveys the sheet P to the second transfer part 98 in a suitable timing and corrects a skew of the sheet P.

The second conveying roller pair 34 conveys not only the sheet P from the cartridge 110 to the pair of the resist rollers 40, but also the sheet loaded (placed) on the manual bypass tray 46A and conveyed by the sheet feeding roller 461 to the pair of the resist rollers 40.

Figure 3:
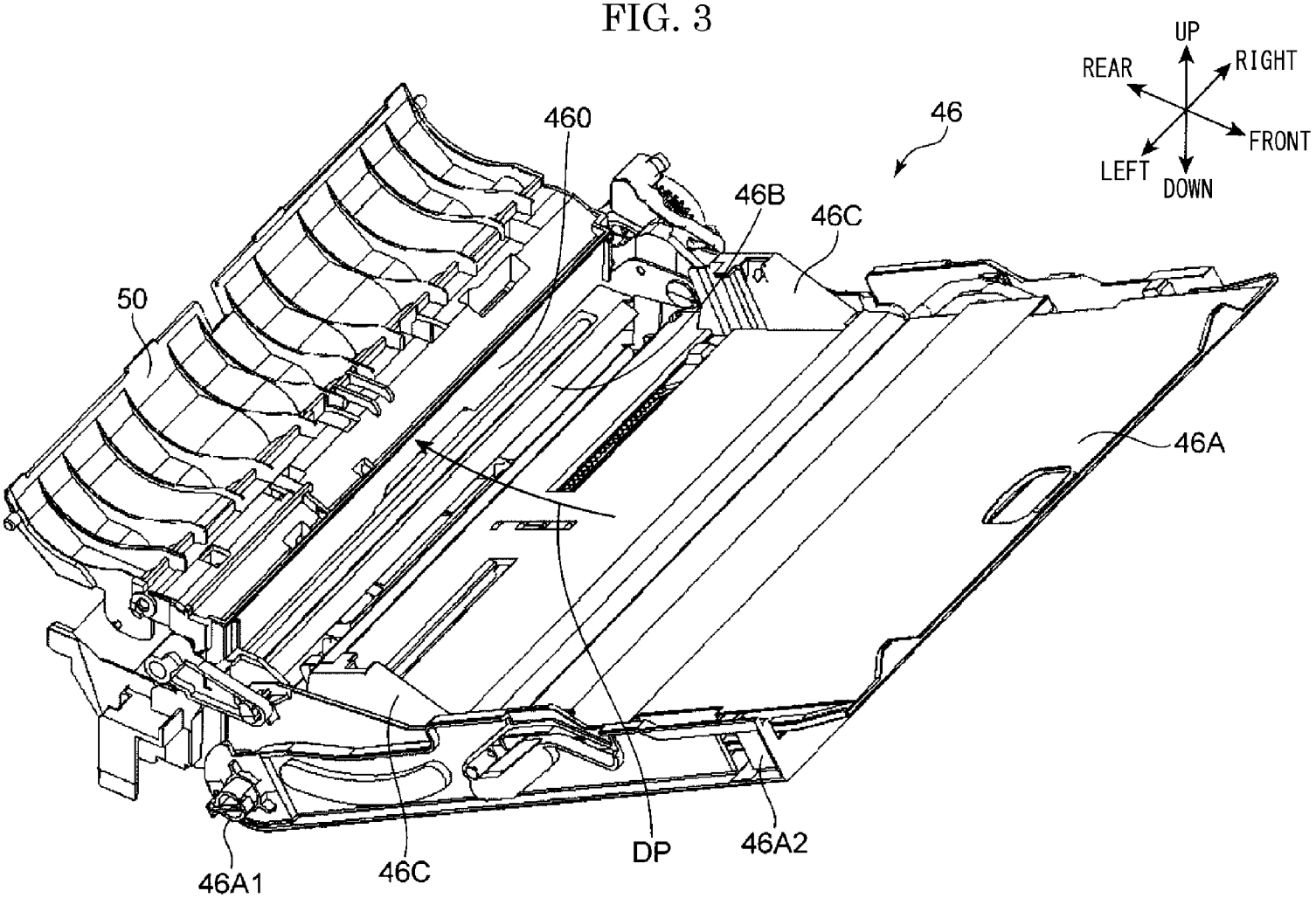
FIG. 3 is a perspective view schematically showing a manual bypass sheet feeding part according to the embodiment of the present disclosure.
Figure 4:
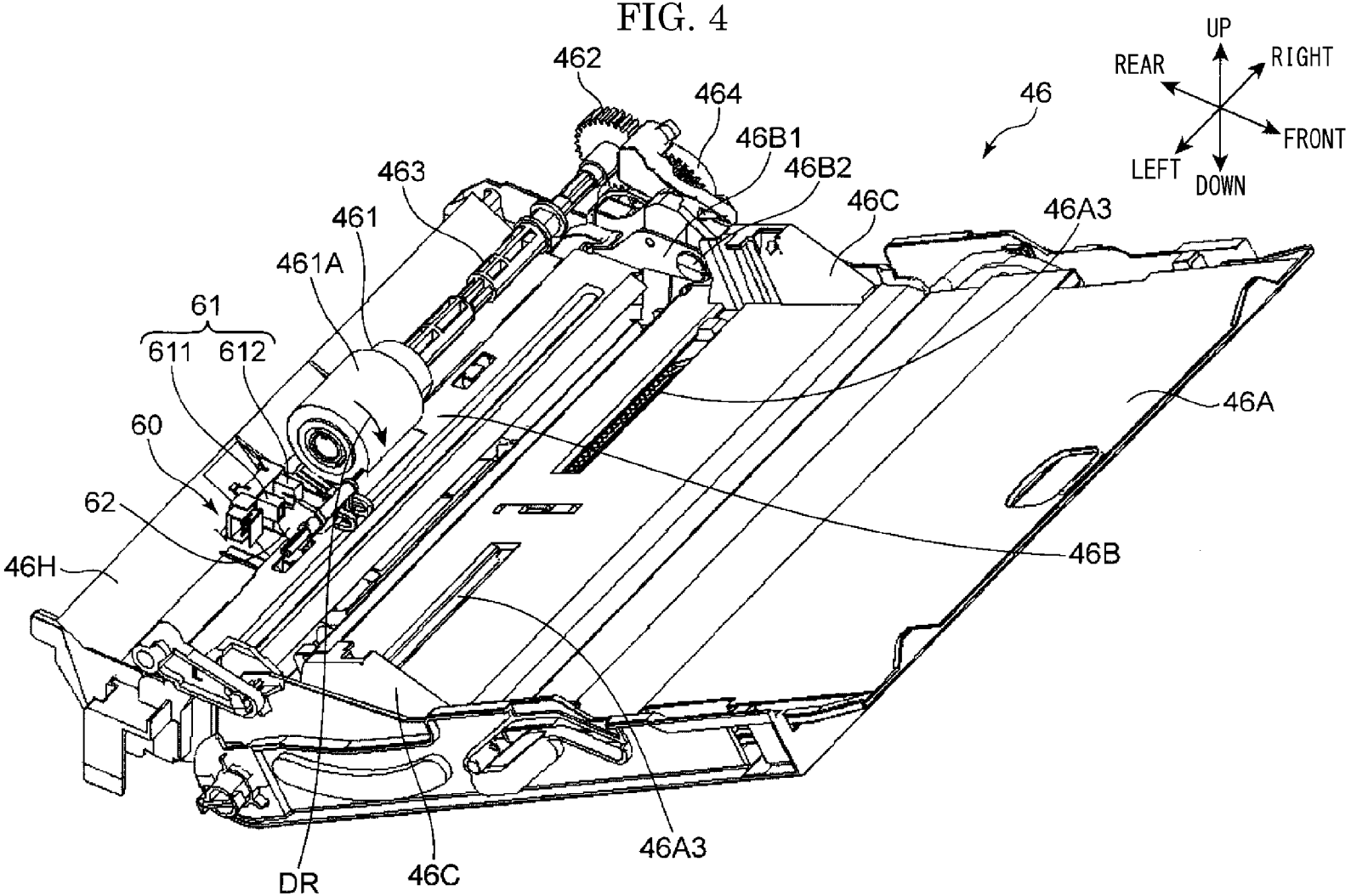
FIG. 4 is a perspective view schematically showing an inside of the manual bypass sheet feeding part according to the embodiment of the present disclosure.
Figure 5:
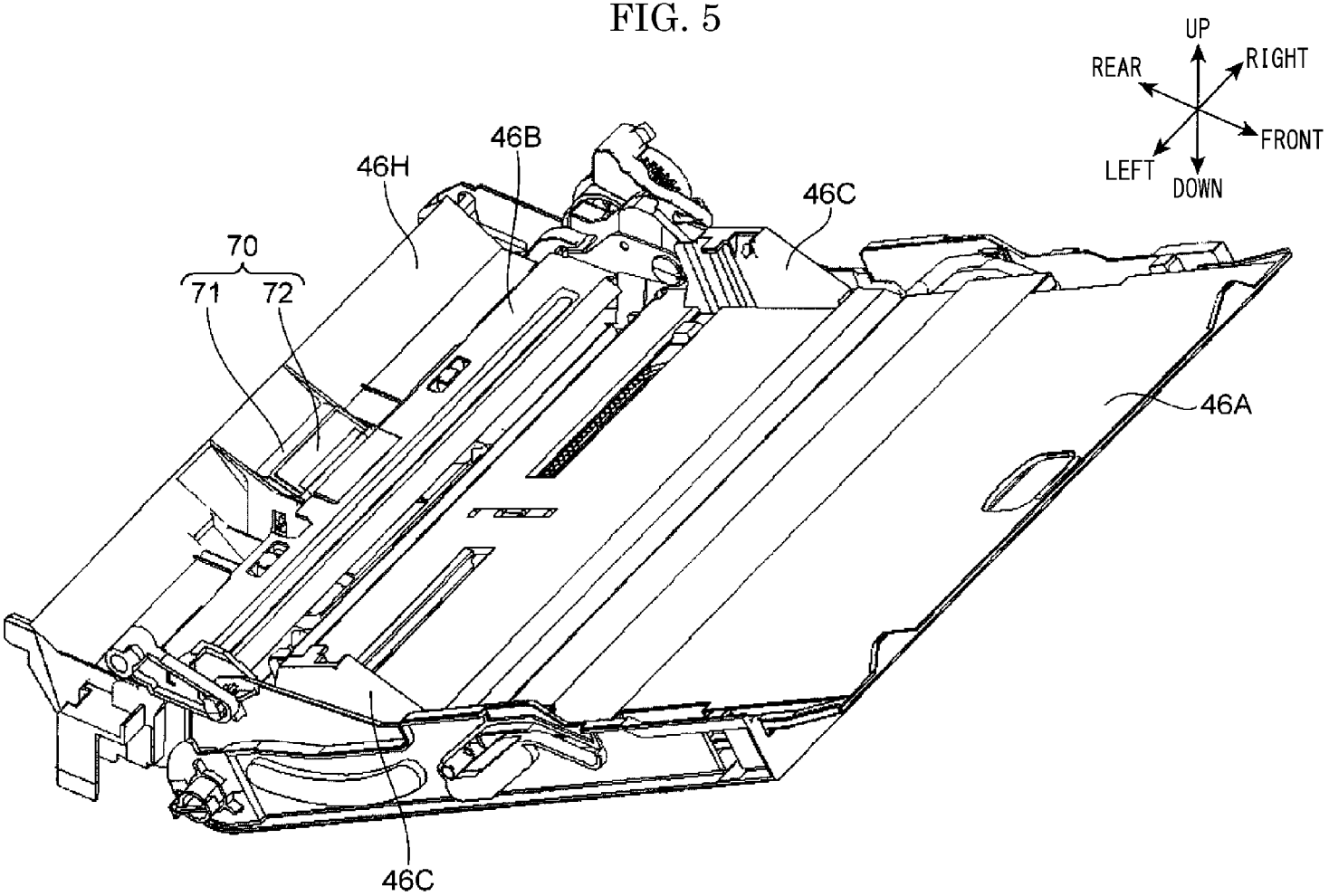
FIG. 5 is a perspective view schematically showing a further inside of the manual bypass sheet feeding part according to the embodiment of the present disclosure.

Next, with reference to FIGS. 3 to 5, the manual bypass sheet feeding part 46 according to the embodiment will be described in detail. FIGS. 3 to 5 are perspective views showing the manual bypass sheet feeding part 46 according to the embodiment. FIG. 4 illustrates a state that an upper guide 50 is detached from the manual bypass sheet feeding part 46 shown in FIG. 3. FIG. 5 illustrates a state that the sheet feeding roller 461 and a sheet detecting part 60 are detached from the manual bypass sheet feeding part 46 shown in FIG. 4.

As referred to FIGS. 3 and 4, the manual bypass sheet feeding part 46 includes the above-mentioned manual bypass tray 46A, a manual bypass lift board 46B, side edge truing-up guides 46C, the upper guide 50, a housing 46H, the sheet feeding roller 461, a drive gear 462 and a shaft 463.

The manual bypass tray 46A is a board-like member being openable/closable to the housing 200. The manual bypass tray 46A is configured so that an upper end part 46A2 is turnable around a lower end part 46A1. On the manual bypass tray 46A, a plurality of the sheets are loaded. The manual bypass sheet conveying path 460 to which the sheet is conveyed from the manual bypass tray 46A extends in a direction indicated by an arrow DP shown in FIG. 3.

The manual bypass lift board 46B is located in a top end part (at the downstream side in the sheet conveying direction) of the manual bypass tray 46A. The manual bypass lift board 46B is a board-like member having a predetermining width in forward and backward directions and extending in left and right directions. The manual bypass lift board 46B includes arm parts 46B1 and a fulcrum part 46B2 (FIG. 4). The arm parts 46B1 projects forward from both end parts in the left and right directions of the manual bypass lift board 46B. The fulcrum part 46B2 is an axis member projecting outward in the left and right directions from a front end of the arm part 46B1. The fulcrum part 46B2 is turned by a transmission cam 464 mentioned below, and accordingly, the manual bypass lift board 46B becomes movable in upward and downward directions. By the movement of the manual bypass lift board 46B, a top end (a left end part) of the sheet sheaf loaded on the manual bypass tray 46A is moved upward. As a result, the leading edge of the sheet is brought into contact with the sheet feeding roller 461.

The side edge truing-up guides 46C are located on the manual bypass tray 46A. The side edge truing-up guides 46C are located as a pair in the left and right directions to regulate a position in a width direction of the sheet. The side edge truing-up guides 46C are configured movably along guide grooves 46A3 formed in the manual bypass tray 46A in the left and right directions.

The upper guide 50 is a cover member covering an upper side of the manual bypass sheet conveying path 460 at the downstream side from the manual bypass lift board 46B in the sheet conveying direction. The housing 46H is located below the upper guide 50. The housing 46H supports the sheet detecting part 60 and a pad holder 71 mentioned below. The housing 46H defines a downward side of the manual bypass sheet conveying path 460.

The sheet feeding roller 461 is located facing to the manual bypass tray 46A in the manual bypass sheet conveying path 460. The sheet feeding roller 461 has a circumference face 461A to be rotated and conveys the sheet in the sheet conveying direction. The sheet feeding roller 461 is rotatably supported at a center part in the left and right directions of the housing 46H. In a right end part of the housing 46H, the drive gear 462 is located. The drive gear 462 is connected to the sheet feeding roller 461 by the shaft 463. The drive gear 462 is rotated by a drive motor (not shown), and accordingly, the sheet feeding roller 461 is rotated via the shaft 463 in a direction (a second direction) indicated by an arrow DR shown in FIG. 4. Moreover, the drive gear 462 is connected to the transmission cam 464. The transmission cam 464 converts rotation force of the drive gear 462 to upward/downward movement of the manual bypass lift board 46B. The transmission cam 464 is connected to the fulcrum part 46B2 of the manual bypass lift board 46B.

As referred to the FIG. 5, the manual bypass sheet feeding part 46 further includes a separation pad part 70. The separation pad part 70 has a function preventing the sheets except for the sheet positioning at an uppermost side in the sheet sheaf loaded on the manual bypass tray 46A from being conveyed to the downstream side in the sheet conveying direction. The separation pad part 70 includes a separation pad (a facing member) 72 and the pad holder 71.

The separation pad 72 is located facing to the circumference face 461A of the sheet feeding roller 461. The separation pad 72 forms, with the circumference face 461A, a nip part N (refer to FIG. 7) into which the sheet is inserted. The separation pad 72 is made of a board-liked elastic member. As an example, the separation pad 72 is made of a rubber member. The separation pad 72 has a high friction coefficient to the sheet. By friction force between the sheet and separation pad 72, the sheets except for the sheet positioning at the uppermost side in the sheet sheaf is prevented from being conveyed to the downstream side in the sheet conveying direction.

The pad holder 71 is located in a center part in the forward and backward directions in the housing 46H. The pad holder 71 supports the separation pad 72.

Figure 6:
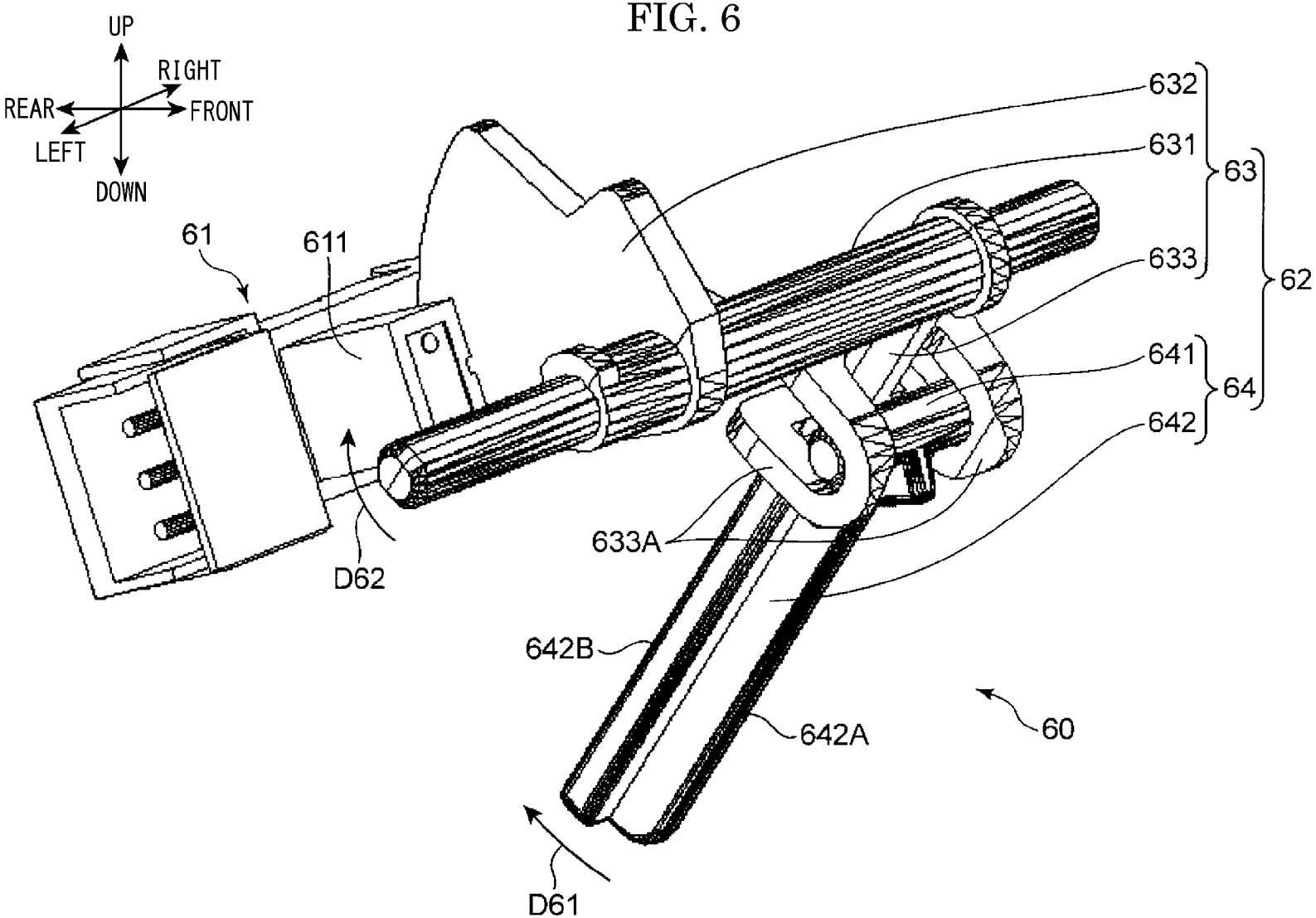
FIG. 6 is a perspective view schematically showing an actuator according to the embodiment of the present disclosure.

In addition, the manual bypass sheet feeding part includes the sheet detecting part 60 (FIG. 4). The sheet detecting part 60 is located at a left side of the sheet feeding roller 461. The sheet detecting part 60 has a function detecting that the sheet is loaded on the manual bypass tray 46A. The sheet detecting part 60 also has a function eliminating the static electricity on the sheet (i.e. static-eliminating the sheet) conveyed to the manual bypass sheet conveying path 460. With reference to FIG. 6 in addition to FIG. 4, the sheet detecting part 60 will be described in detail. FIG. 6 is a perspective view showing the sheet detecting part 60. The sheet detecting part 60 includes a sensor part (a sensor) 61 and an actuator 62.

The sensor part 61 is a through-beam type sensor located facing to the actuator 62 in the housing 62H. The sensor part 61 includes a light emitting part 611 and a light receiving part 612 (FIG. 4). The light emitting part 611 and light receiving part 612 are located at an interval from each other in the left and right directions. The light emitting part 611 emits detection light and the light receiving part 612 receives it. When a detected piece 632 mentioned below of the actuator 62 is entered between the light emitting part 611 and light receiving part 612, the detection light is cut off. As a result, the sensor part 61 detects movement of the detected piece 632.

The actuator 62 is swingably supported to the housing 200 (the upper guide 50) in front of the sensor part 61. The actuator 62 is located at a slight upward side from the nip part N (refer to FIG. 7) formed between the sheet feeding roller 461 and separation pad 72 in the sheet conveying direction (in the direction indicated by the arrow DP shown in FIG. 3). The actuator 62 includes a detected part 63 and a contact part 64 (a swinging member).

The detected part 63 includes an axis part 631, the detected piece 632 and a fixing part 633. The detected part 63 is made of a non-conductive member. In the embodiment, the detected part 63 is made of an insulated resin material.

The axis part 631 is a bar-like member extending in the left and right directions. Both end parts in the left and right directions of the axis part 631 are inserted into bearing parts (not shown) of the upper guide 50, and accordingly, the axis part 631 is rotatably supported to the upper guide 50.

The detected piece 632 projects in a radial direction of the axis part 631 from a slight left side part from a center part in the left and right directions of the axis part 631. The detected piece 632 is a roughly fan-formed board-like member. The detected piece 632 is configured enterably between the light emitting part 611 and light receiving part 612.

The fixing part 633 is located in a slight right side part from the center part in the left and right directions of the axis part 631. The fixing part 633 is located in a different area from the detected piece 632 in a circumferential direction of the axis part 631. The fixing part 633 projects in the radial direction from the axis part 631. The fixing part 633 includes inserting parts 633A. The inserting parts 633A are a pair of bearing members located at an interval from each other in the left and right directions. In the pair of the inserting parts 633A, an inserting axis part 641 mentioned below of the contact part 64 is inserted.

The contact part 64 is a roughly bar-like member connected to the detected part 63. The contact part 64 is made of an electro-conductive member. In the embodiment, the contact part 64 is made of a metal material. The contact part 64 includes the inserting axis part 641 and a contact piece 642.

The inserting axis part 641 is an axis part extending in the left and right directions in an upper end part of the contact part 64. The inserting axis part 641 is inserted in the pair of the inserting parts 633A of the detected part 63. As a result, the contact part 64 is fixed to the detected part 63 in a body. The contact piece 642 is a bar-like part extending downward from the inserting axis part 641. The contact piece 642 includes a sheet contact part (a first contact part) 642A and a spring contact part (a second contact part) 642B. The sheet contact part 642A is a front end face of the contact piece 642. With the sheet contact part 642A, the leading edge of the sheet fed from the manual bypass tray 46A is brought into contact. The spring contact part 642B is a rear end face of the contact piece 642. The spring contact part 642B is configured to come into contact with a static-eliminating spring 80 mentioned below. When the contact part 64 is fixed to the inserting parts 633A of the detected part 63, the contact part 64 is swingably supported to the housing 200 via the axis part 631 of the detected part 63. In other words, in a state that the contact part 64 and detected part 63 are connected to each other, the actuator 62 becomes swingable about the axis part 631 in a direction (a first direction) indicated by an arrow D61 shown in FIG. 6.

Figure 7:
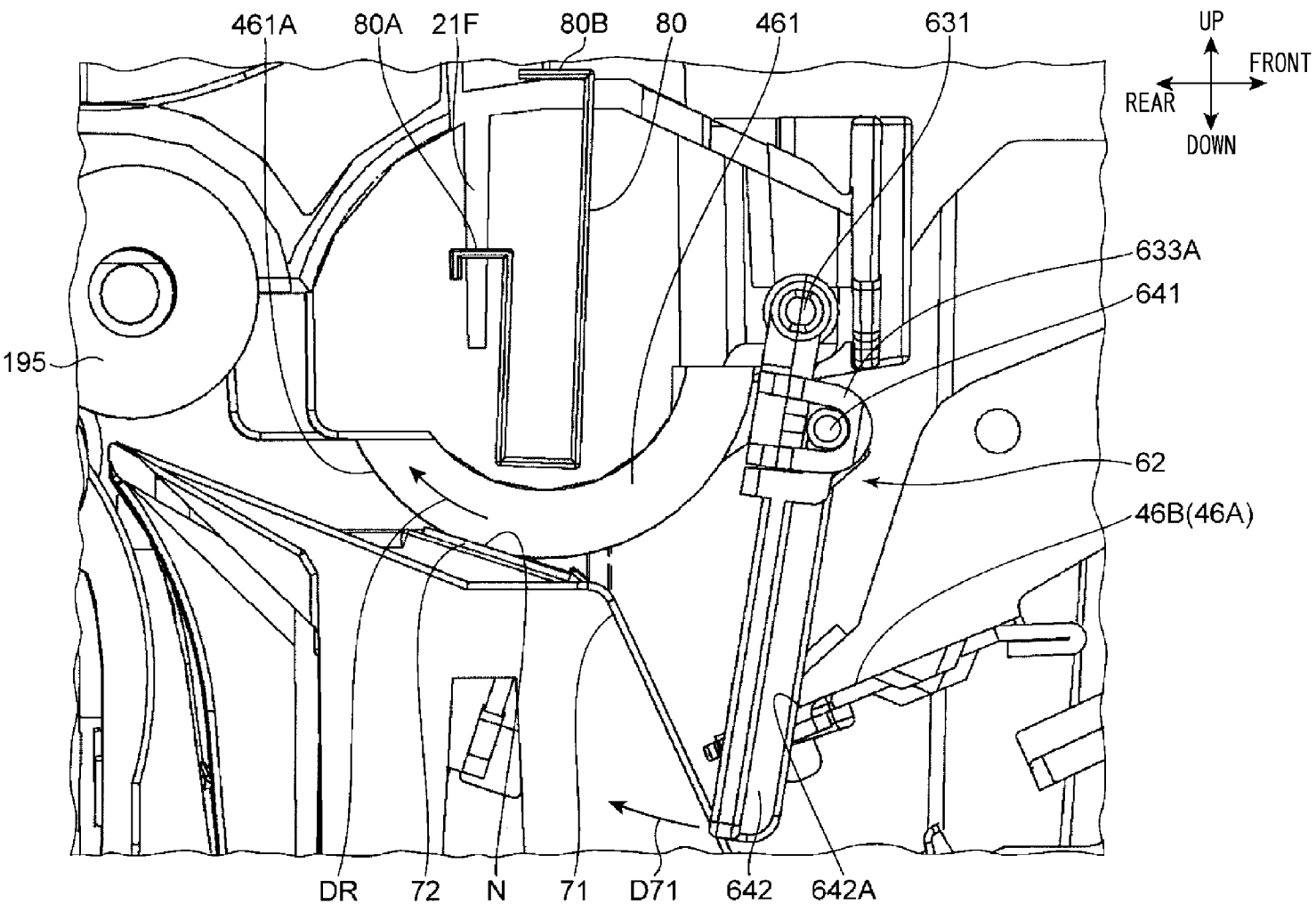
FIG. 7 is an enlarged sectional view schematically showing the manual bypass sheet feeding part, in a situation of loading no sheet, according to the embodiment of the present disclosure.

Moreover, the manual bypass sheet feeding part 46 includes the static-eliminating spring (a grounding member) 80 (FIG. 7). The static-eliminating spring 80 is located at a position facing to the actuator 62 in a state swinging in the forward and backward directions. The static-eliminating spring 80 is an electro-conductive flat spring member. The static-eliminating spring 80 is formed by bending a metal board member with a slight width in the left and right directions at several points. In another embodiment, the static-eliminating spring 80 may be a coil-like spring member or the like. The static-eliminating spring 80 has a spring fixed part 80A and a spring top end part 80B. The spring fixed part 80A is one end side of the static-eliminating spring 80 and is fixed to a fixing part 21F of the housing 200. The fixing part 21F is electrically grounded via the housing 200. The spring top end part 80B is another end side of the static-eliminating spring 80 and forms a free end of the static-eliminating spring 80. That is, the spring top end part 80B of the static-eliminating spring 80 is configured swingably from the spring fixed part 80A as a fulcrum.

Figure 8:
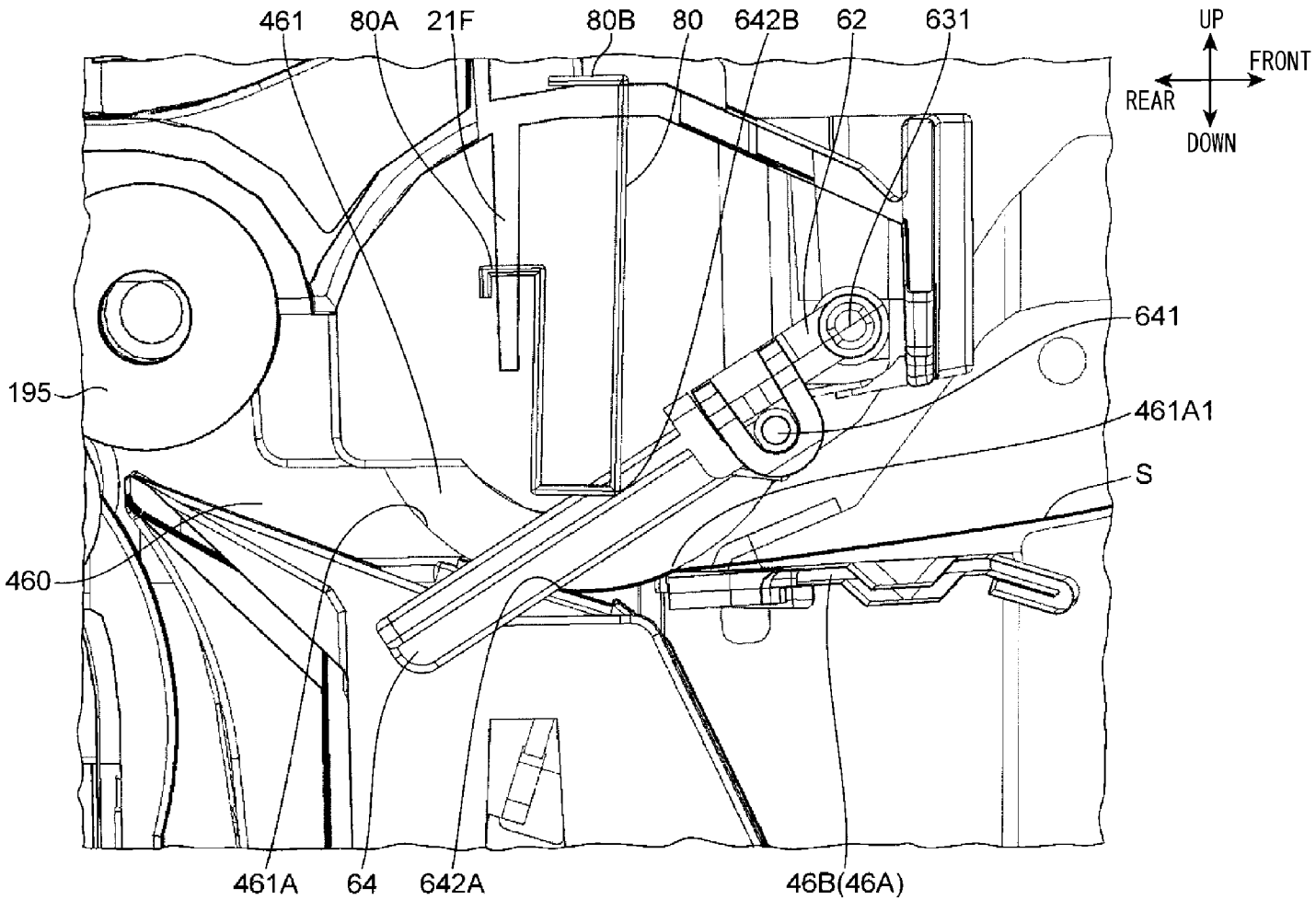
FIG. 8 is an enlarged sectional view schematically showing the manual bypass sheet feeding part, in a situation of feeding the sheet, according to the embodiment of the present disclosure.

Next, with reference to FIGS. 7 and 8 in addition to FIGS. 4 and 6, the work of the sheet detecting part 60 according to the embodiment will be described. FIG. 7 is an enlarged sectional view showing the manual bypass sheet feeding part 46, in a situation where no sheet is loaded on the manual bypass tray 46A, according to the embodiment. FIG. 8 is an enlarged sectional view showing the manual bypass sheet feeding part 46, in a situation where the sheet is loaded on the manual bypass tray 46A and the sheet is fed from the manual bypass tray 46A, according to the embodiment.

As shown in FIG. 7, in a case where the sheet is not loaded on the manual bypass tray 46A (the manual bypass lift board 46B), the contact piece 642 of the contact part 64 is arranged so as to extend roughly downward. At this moment, the detected piece 632 of the contact part 64 is located at a position shown in FIG. 6 and entered between the light emitting part 611 and light receiving part 612 of the sensor part 61. Therefore, such a case is in a situation in which the detected piece 632 is detected by the sensor part 61 and a HIGH signal (a signal of five volts) is outputted from the sensor part 61 to a controlling part (not shown).

In this situation, if the user loads the sheet P on the manual bypass tray 46A, the leading edge of the sheet P is brought into contact with the sheet contact part (the first contact part) 642A as the front end face of the contact piece 642 (FIG. 7). The actuator 62 then swings from the axis part 631 as a fulcrum in the direction (a first direction) indicated by the arrow D61 shown in FIG. 6 and an arrow D71 shown in FIG. 7. As a result, the detected piece 632 is separated upward from between the light emitting part 611 and light receiving part 612. The sensor part 61 outputs a LOW signal (a signal of zero volt) to the controlling part (not shown). According to this, the movement of the detected piece 632 is detected and the loading of the sheet P on the manual bypass tray 46A is detected. Incidentally, as mentioned above, the detected part 63 is made of the insulated material. Because of this, even if the leading edge of the sheet P is brought into contact with the sheet contact part 642A, the static electricity (an electrical charge) on the sheet P is not applied to the detected part 63. Therefore, misdetection and failure of the sensor part 61 caused by the static electricity are prevented.

In forming an image in the image forming apparatus 1, if the user choices the manual bypass tray 46A as a sheet loading part, the drive gear 462 (FIG. 4) is driven to rotate and the manual bypass lift board 46B is moved upward. As a result, the leading edge of the sheet P is lifted upward by the manual bypass lift board 46B (refer to FIG. 7).

By lifting upward the sheet P, the leading edge of the sheet P lifts upward the sheet contact part 642A. As a result, the actuator 62 is further swung about the axis part 631 and the spring contact part 642B of the contact part 64 comes into contact with the static-eliminating spring 80. As mentioned above, the contact part 64 is made of the electro-conductive member and the static-eliminating spring 80 is grounded. According to this, a communication path is formed so as to run from the sheet contact part 642A being in contact with the sheet P via the spring contact part 642B to the static-eliminating spring 80. Therefore, if the sheet P is in a state having the static electricity, electric charge on the sheet P is discharged via the communication path outside the image forming apparatus 1. In other words, the sheet P is suitably static-eliminated. Incidentally, because the static-eliminating spring 80 is the spring member, impact when the spring contact part 642B comes into contact with the static-eliminating spring 80 is reduced. As a result, by the swing of the contact part 64, brakes are applied to the sheet P and obstruction in the conveyance of the sheet P is suppressed.

The sheet P is brought into contact with the circumference face 461A at a position 461A1 at an upstream side from the nip part N in the rotation direction (the second direction) of the sheet feeding roller 461 and is fed in the sheet conveying direction. At this moment, because the contact part 64 is in a state being in contact with a sheet face of the sheet P, the sheet P is static-eliminated, and simultaneously, inserted to the nip part N. According to this, if the sheet sheaf having a plurality of the sheets P is loaded on the manual bypass tray 46A and several sheets P are advanced from the sheet sheaf lifted by the manual bypass lift board 46B to the nip part N, adhesion force caused by the static electricity between the sheets P is reduced. Therefore, between the sheet feeding roller 461 and separation pad 72, the plurality of the sheets P are suitably separated (divided) from each other and one sheet positioning at the uppermost side is conveyed from the nip part N to the manual bypass sheet conveying path 460 at the downstream side in the sheet conveying direction.

In the foregoing, in accordance with the above-mentioned embodiment, the sheet P loaded (placed) on the manual bypass tray 46A is conveyed in the predetermined conveying direction by the sheet feeding roller 461. The contact part 64 is swingably supported to the housing 200. When the sheet P is conveyed by the sheet feeding roller 461, the sheet P is brought into contact with the sheet contact part 642A and the contact part 64 is swung in the first direction. As a result, the spring contact part 642B of the contact part 64 comes into contact with the static-eliminating spring 80. Because the contact part 64 is made of the electro-conductive member, the electric charge on the sheet P is eliminated via the contact part 64 by the static-eliminating spring 80. According to this, the sheet P is conveyed in a state being suitably and stably static-eliminated through the manual bypass sheet conveying path 460. Therefore, the image is stably formed on the sheet P.

In accordance with the above-mentioned embodiment, the contact part 64 is located at the upstream side from the nip part N in the conveying direction. The sheet P is brought into contact with the circumference face 461A of the sheet feeding roller 461 and is conveyed to the nip part N. At this moment, the sheet P is advanced in a state being in contact with the sheet contact part 642A to the nip part N. According to this, the sheet P is static-eliminated by the contact part 64, and simultaneously, inserted to the nip part N. As a result, the adhesion of the sheets P to each other caused by the electric charge on the sheet P is suppressed and occurrence of feeding of the several sheets P, i.e. overlapped feeding, is restrained.

In accordance with the above-mentioned embodiment, the actuator 62 includes the contact part 64 and detected piece 632. If the sheet P is loaded on the manual bypass tray 46A, the actuator 62 is swung in the first direction and the movement of the detected piece 632 is detected by the sensor part 61. As a result, the actuator 62 including the contact part 64 serves both as the static-elimination of the sheet P and a function of presence detection of the sheet P.

In accordance with the above-mentioned embodiment, the actuator 62 includes the axis part 631, contact part and detected piece 632. The contact part 64 and detected piece 632 are projected from the axis part 631 in respective different directions. By the swing of the actuator 62 about the axis part 631, the static-elimination of the sheet P and the presence detection of the sheet P are suitably actuated.

In accordance with the above-mentioned embodiment, because the detected piece 632 is made of the non-conductive member, movement of the electric charge from the contact part 64 to the detected piece 632 is suppressed. According to this, when the through-beam type sensor part 61 detects the movement of the detected piece 632, the misdetection and failure of the sensor part 61 caused by the electric charge are restrained.

In accordance with the above-mentioned embodiment, the static-eliminating spring 80 is composed of the spring member extending from the housing and facing to the spring contact part 642B in the state swinging in the first direction. According to this, the impact when the spring contact part 642B comes into contact with the static-eliminating spring 80 is reduced. As a result, by the swing of the contact part 64, the obstruction in the conveyance of the sheet P is suppressed.

Although, in the foregoing, the manual bypass sheet feeding part 46 according to the embodiment of the present disclosure and image forming apparatus 1 including this were described, the disclosure is not restricted to this. For example, the disclosure may apply another following varied embodiment.

Although, in the above-mentioned embodiment, the sheet feeding device was described by using the manual bypass sheet feeding part 46, the disclosure is not restricted to this. The sheet feeding device may be the sheet feeding device 30 arranged facing to the cartridge 110. Even in such a case, the sheet P is stably fed from the lift board 43 in a state being suitably static-eliminated. If the image forming apparatus 1 is the multifunction peripheral, the sheet feeding device may be arranged to an automatic document feeding device (ADF) installed in the image forming apparatus 1. In such a case, the sheet feeding device is correspondent to a document conveying part feeding a document to a reading position in the automatic document feeding device. The image forming apparatus 1 includes an image reading device and the image forming unit 93. The image reading device includes the sheet feeding device having the contact part 64 and a reading unit (a reading part, not shown) arranged facing to the sheet conveying path of the sheet feeding device and configured to read a document image on the sheet. The image forming unit 93 forms the image on the sheet on the basis of the document image read by the reading unit. Even in such a case, the document is stably fed to the reading position in a state being suitably static-eliminated, the document image on the static-eliminated sheet is stably read by the reading part, and then, the image is stably formed on the sheet.

Although, in the above-mentioned embodiment, a situation in which, by loading the sheet on the manual bypass tray 46A, the detected piece 632 is separated from the sensor part 61 was described, the disclosure is not restricted to this. The disclosure may apply another situation in which the detected piece 632 is separated from the sensor part 61 when the sheet is not loaded on the manual bypass tray 46A, while, by loading the sheet on the manual bypass tray 46A, the actuator 62 is swung and the detected piece 632 is entered between the light emitting part 611 and light receiving part 612.

Although, in the above-mentioned embodiment, a situation in which the sensor part 61 is composed of the through-beam type light sensor was described, the disclosure is not restricted to this. The sensor part 61 may be a pressure sensor having a piezo-electric element. When the leading edge of the sheet P is brought into contact with the sheet contact part 642A and the actuator 62 is swung, the detected piece 632 comes into contact with the pressure sensor, and accordingly, the loading of the sheet P is detected. Alternatively, the sensor part 61 may be composed of another detection sensor.

Although, in the above-mentioned embodiment, a situation in which the actuator 62 is composed of the detected part 63 and contact part 64 and serves both as the function detecting the loading of the sheet P (a sheet presence detection function) and a function static-eliminating the sheet P was described, the disclosure is not restricted to this. The actuator 62 may be configured to serve the function static-eliminating the sheet P without the detected piece 632.

While the present disclosure has been described with reference to the preferable embodiment of the sheet feeding device, image reading device and image forming apparatus of the disclosure and the description has technical preferable illustration, the disclosure is not to be restricted by the embodiment and illustration. Components in the embodiment of the present disclosure may be suitably changed or modified, or variously combined with other components. The claims are not restricted by the description of the embodiment.

What is claimed is:

1. A sheet feeding device comprising:

a housing;

a grounding member arranged to the housing and electrically grounded;

a sheet loading part arranged to the housing, on which a sheet is placed;

a sheet conveying path extending from the sheet loading part, in which the sheet is conveyed in a predetermined conveying direction;

a sheet feeding part arranged facing to the sheet loading part and configured to convey the sheet on the sheet loading part in the conveying direction; and a swinging member being made of an electro-conductive member swingably supported to the housing so as to be swung in a first direction by bringing the sheet conveyed from the sheet loading part into contact with the swinging member, wherein the swinging member includes a first contact part with which the sheet is brought into contact and a second contact part coming into contact with the grounding member accompanying to the swing in the first direction of the swinging member.

2. The sheet feeding device according to claim 1, wherein the sheet feeding part includes a sheet feeding roller having a circumference face driven and rotated in a second direction and a facing member arranged facing to the sheet feeding roller and configured to form a nip part with the circumference face, the swinging member is arranged at an upstream side from the nip part in the conveying direction, and the sheet placed on the sheet loading part is fed in the conveying direction by coming into contact with the circumference face at a position at an upstream side from the nip part in the second direction and is advanced to the nip part in a state coming into contact with the first contact part of the swinging member.

3. The sheet feeding device according to claim 1 further comprising:

an actuator including the swinging member and a detected piece connected to the swinging member and being swingable in the first direction;

a lift board arranged to the sheet loading part to move in upward and downward directions and configured to have a top face on which the sheet is placed; and a sensor arranged facing to the detected piece in the housing and configured to detect the detected piece, wherein, when the leading edge of the sheet placed on the lift board in a state being moved downward comes into contact with the first contact part, the actuator is swung in the first direction and the sensor detects movement of the detected piece.

4. The sheet feeding device according to claim 3, wherein the actuator includes an axis part configured to be rotated, the swinging member projected from the axis part in a radial direction and the detected piece projected from the axis part in a different direction from the swinging member and is configured to swing about the axis part in the first direction.

5. The sheet feeding device according to claim 3, wherein the sensor is a through-beam type sensor, and the detected piece is made of a non-conductive member.

6. The sheet feeding device according to claim 1, wherein the grounding member is an electro-conductive spring member extending from the housing and facing to the swinging member in a state swinging in the first direction.

7. An image forming apparatus comprising:

an image forming part forming an image on a sheet; and a sheet feeding device conveying the sheet to the image forming part, wherein the sheet feeding device includes:

a housing;

a grounding member arranged to the housing and electrically grounded;

a sheet loading part arranged to the housing, on which a sheet is placed;

a sheet conveying path extending from the sheet loading part, in which the sheet is conveyed in a predetermined conveying direction;

a sheet feeding part arranged facing to the sheet loading part and configured to convey the sheet on the sheet loading part in the conveying direction; and a swinging member being made of an electro-conductive member swingably supported to the housing so as to be swung in a first direction by bringing the sheet conveyed from the sheet loading part into contact with the swinging member, wherein the swinging member includes a first contact part with which the sheet is brought into contact and a second contact part coming into contact with the grounding member accompanying to the swing in the first direction of the swinging member.

8. The image forming apparatus according to claim 7, wherein the sheet feeding part includes a sheet feeding roller having a circumference face driven and rotated in a second direction and a facing member arranged facing to the sheet feeding roller and configured to form a nip part with the circumference face, the swinging member is arranged at an upstream side from the nip part in the conveying direction, and the sheet placed on the sheet loading part is fed in the conveying direction by coming into contact with the circumference face at a position at an upstream side from the nip part in the second direction and is advanced to the nip part in a state coming into contact with the first contact part of the swinging member.

9. The image forming apparatus according to claim 7 further comprising:

an actuator including the swinging member and a detected piece connected to the swinging member and being swingable in the first direction;

a lift board arranged to the sheet loading part to move in upward and downward directions and configured to have a top face on which the sheet is placed; and a sensor arranged facing to the detected piece in the housing and configured to detect the detected piece, wherein, when the leading edge of the sheet placed on the lift board in a state being moved downward comes into contact with the first contact part, the actuator is swung in the first direction and the sensor detects movement of the detected piece.

10. The image forming apparatus according to claim 9, wherein the actuator includes an axis part configured to be rotated, the swinging member projected from the axis part in a radial direction and the detected piece projected from the axis part in a different direction from the swinging member and is configured to swing about the axis part in the first direction.

11. The image forming apparatus according to claim 9, wherein the sensor is a through-beam type sensor, and the detected piece is made of a non-conductive member.

12. The image forming apparatus according to claim 7, wherein the grounding member is an electro-conductive spring member extending from the housing and facing to the swinging member in a state swinging in the first direction.

13. The image forming apparatus according to claim 7, wherein the sheet loading part is a manual bypass tray.

14. An image reading device comprising:

a reading part arranged facing to a conveying path of a sheet and configured to read a document image on the sheet; and a sheet feeding device conveying the sheet to the reading part, wherein the sheet feeding device includes:

a housing;

a grounding member arranged to the housing and electrically grounded;

a sheet loading part arranged to the housing, on which a sheet is placed;

a sheet conveying path extending from the sheet loading part, in which the sheet is conveyed in a predetermined conveying direction;

a sheet feeding part arranged facing to the sheet loading part and configured to convey the sheet on the sheet loading part in the conveying direction; and a swinging member being made of an electro-conductive member swingably supported to the housing so as to be swung in a first direction by bringing the sheet conveyed from the sheet loading part into contact with the swinging member, wherein the swinging member includes a first contact part with which the sheet is brought into contact and a second contact part coming into contact with the grounding member accompanying to the swing in the first direction of the swinging member.

15. The image reading device according to claim 14, wherein the sheet feeding part includes a sheet feeding roller having a circumference face driven and rotated in a second direction and a facing member arranged facing to the sheet feeding roller and configured to form a nip part with the circumference face, the swinging member is arranged at an upstream side from the nip part in the conveying direction, and the sheet placed on the sheet loading part is fed in the conveying direction by coming into contact with the circumference face at a position at an upstream side from the nip part in the second direction and is advanced to the nip part in a state coming into contact with the first contact part of the swinging member.

16. The image reading device according to claim 14 further comprising:

an actuator including the swinging member and a detected piece connected to the swinging member and being swingable in the first direction;

a lift board arranged to the sheet loading part to move in upward and downward directions and configured to have a top face on which the sheet is placed; and a sensor arranged facing to the detected piece in the housing and configured to detect the detected piece, wherein, when the leading edge of the sheet placed on the lift board in a state being moved downward comes into contact with the first contact part, the actuator is swung in the first direction and the sensor detects movement of the detected piece.

17. The image reading device according to claim 16, wherein the actuator includes an axis part configured to be rotated, the swinging member projected from the axis part in a radial direction and the detected piece projected from the axis part in a different direction from the swinging member and is configured to swing about the axis part in the first direction.

18. The image reading device according to claim 16, wherein the sensor is a through-beam type sensor, and the detected piece is made of a non-conductive member.

19. The image reading device according to claim 14, wherein the grounding member is an electro-conductive spring member extending from the housing and facing to the swinging member in a state swinging in the first direction.

20. An image forming apparatus comprising:

a sheet feeding device conveying a sheet as a document;

a reading part arranged facing to a conveying path of the sheet and configured to read a document image on the sheet; and an image forming part forming an image on the sheet on the basis of the document image read by the reading part, wherein the sheet feeding device includes:

a housing;

a grounding member arranged to the housing and electrically grounded;

a sheet loading part arranged to the housing, on which a sheet is placed;

a sheet conveying path extending from the sheet loading part, in which the sheet is conveyed in a predetermined conveying direction;

a sheet feeding part arranged facing to the sheet loading part and configured to convey the sheet on the sheet loading part in the conveying direction; and a swinging member being made of an electro-conductive member swingably supported to the housing so as to be swung in a first direction by bringing the sheet conveyed from the sheet loading part into contact with the swinging member, wherein the swinging member includes a first contact part with which the sheet is brought into contact and a second contact part coming into contact with the grounding member accompanying to the swing in the first direction of the swinging member.

* * * * *